United States Patent [19]

Ohta et al.

[11] 4,128,426

[45] Dec. 5, 1978

[54] PROCESS FOR SUBBING PHOTOGRAPHIC HYDROPHOBIC FILMS

[75] Inventors: Hideyasu Ohta; Takahiro Uozumi; Masaru Kanbe; Naoto Abe; Jun Shirasaki; Masayoshi Mayama, all of Hino, Japan

[73] Assignee: Konishiroku Photo Industry Co., Ltd., Tokyo, Japan

[21] Appl. No.: 772,082

[22] Filed: Feb. 25, 1977

[30] Foreign Application Priority Data

Mar. 1, 1976 [JP] Japan ..... 51-21986

[51] Int. Cl.[2] ..... B05D 3/06

[52] U.S. Cl. ..... 96/87 R; 427/40; 427/54; 427/407 C; 427/407 G

[58] Field of Search ..... 96/87 R; 427/407 R, 427/407 C, 407 G, 40, 54

[56] References Cited

U.S. PATENT DOCUMENTS

| | | | |
|---|---|---|---|
| 3,645,740 | 2/1972 | Nishio et al. | 96/87 R |
| 3,834,928 | 9/1974 | Tatsuta et al. | 96/87 R |
| 3,941,727 | 3/1976 | Timmerman et al. | 96/87 R |

*Primary Examiner*—John H. Newsome

*Attorney, Agent, or Firm*—Bierman & Bierman

[57] ABSTRACT

The present application is directed to a process for subbing a photographic hydrophobic film which involves subjecting at least one surface of the film to a hydrophylizing pretreatment step, coating the pretreated surface with an aqueous dispersion containing a polymer which has particular comonomers in a combined amount of more than 76%, then coating the coated surface with a liquid containing colloidal silica.

12 Claims, No Drawings

PROCESS FOR SUBBING PHOTOGRAPHIC HYDROPHOBIC FILMS

BACKGROUND OF THE INVENTION

This invention relates to a process for subbing a photographic hydrophobic film. More particularly, the invention pertains to a process for subbing a photographic hydrophobic film in order to improve adhesion of a light-sensitive photographic layer which is coated on the hydrophobic film to form a light-sensitive composite photographic material, especially in order to improve the resulting light-sensitive materials ability to resist edge-peeling in a treating bath. The process comprises applying, on the surface of the hydrophobic film, an aqueous dispersion containing a copolymer comprising, as the main components, (1) glycidyl methacrylate and/or glycidyl acrylate and (2) a compound of the general formula $$CH_2{=}\underset{\underset{R_1}{|}}{C}{-}COOR_2.$$

It is difficult to obtain satisfactory adhesion between a hydrophilic material such as gelatin, and a hydrophobic support surface because of the lack of affinity between said material and said surface. Even if a coating can be formed on the hydrophobic surface, the adhesion is weak and, consequently, the hydrophobic material tends to peel off from the hydrophobic support.

Accordingly, it has heretofore been common practice to subject at least one surface of a hydrophobic support to a subbing treatment before applying the coating material.

However, in a light-sensitive photographic material, it is necessary to make the hydrophilic material adhere strongly to the hydrophobic support since the photographic material is treated under a variety of conditions. For example, the photographic film must be wet during the development treatment and dry before and after the development treatment.

Therefore, attempts have been made to improve adhesion between the hydrophilic material and the support. For instance, a vinylidene type terpolymer containing an acid moiety having an affinity for both a support film and a light-sensitive photographic layer or a polymer obtained by grafting a butyl acrylate/styrene copolymer on gelatin or a butadiene type polymer is dissolved, for example, in ethylene chloride, dioxane, acetone or methyl alcohol is used to form a solution. The resulting solution is added to an organic solvent such as chlorophenol or cresol which acts as a solvent or swelling agent for the support film then, this solution is coated on the surface of the substrate in order to obtain greater adhesion between the support film and the light-sensitive photograhic layer.

The disadvantage of the above-mentioned method involves the use of the solvent type subbing liquid which releases a vapor when dried which is harmful to the environment. Additionally, the subbed film eventually fails to maintain its transparent appearance as well as its flatness. This results in noticeable degradation of the resulting subbed film.

Under such circumstances, there is adopted, for example, a method wherein the suppprt film is coated (before stretching or after monoaxial stretching but before biaxial stretching thereof) on the surface with a solvent type subbing liquid which does not contain a solvent or swelling agent for the support film. This method is disadvantageous because a large amount of the perimeter material must be discarded due to the waste material formed by stretching the support film.

In order to overcome this drawback there is a method in which an aqueous dispersion containing a copolymer obtained from various monomers is used as a subbing liquid in place of the aforesaid solvent type subbing liquid. For example, U.S. Pat. No. 3,615,556 discloses a subbing process in which a biaxially stretched polyester film is coated with an aqueous dispersion containing a butadiene/styrene copolymer having an acid moiety.

U.S. Pat. No. 2,627,088 and 2,698,240, respectively disclose a process in which, prior to stretching, a polyester film is subbed on the surface with an aqueous dispersion containing a vinylidene type copolymer having an acid moiety. Further, Japanese Patent Publications Nos. 13278/1969 and 10988/1970, respectively disclose a process in which the surface of a biaxially stretched polyester film is coated with an aqueous dispersion containing a copolymer obtained from an alkyl acrylate and an aliphatic bifunctional monomer having two allyl or vinyl groups. However, it is difficult to properly select the aqueous dispersion and subbing conditions necessary to achieve excellent adhesion.

On the other hand, a process has been proposed which subjects a hydrophobic film to pretreatment rendering the surface hydrophilic. Examples of the pretreatment include corona discharge and ultraviolet irradiation. Subsequently, the pretreated surface of the film is coated with a subbing liquid.

The adhesion of the hydropholic layer to the hydrophobic film has been greatly improved by application of this process to the aforesaid subbing process using an aqueous copolymer dispersion. For instance, Japanese Laid-Open-to-Public Publication No. 11118/1974 discloses a light-sensitive silver halide photogrphic material obtained by coating a silver halide emulsion layer on a polyester film support which had been previously pretretreated to render it hydrophilic. The surface of the film support is coated with an aqueous copolymer dispersion. The resulting film exhibited excellent adhesion from its initial preparation to the drying stage subsequent to development.

However, the photographic material prepared as described above does not exhibit satisfactory results with regard to edge peeling when the photographic material was subjected to development by means of an automatic developing machine. The term "edge-peeling" refers to the peeling of the silver halide emulsion layer when the edges of said layer are rubbed with a finger or piece of soft rubber during the development of a light-sensitive silver halide photographic material while wet.

The problems associated with edge peeling arise, for example, when a light-sensitive silver halide photographic material is developed by means of an automatic developing machine and is rubbed with a travelling rack or rubber roll. The silver halide emulsion layer formed thereon peels from the perimeter portions of said photographic material. This results in significant deterioration of the quality of the developed photographic material. Further, the prior art subbing processes using an aqueous dispersion type subbing liquid provide unsatisfactory results because of the occurrence of the so-called blocking phenomenon. This results from the incorporation of a surface active agent and a polymerization initiator into the aqueous copolymer dispersion. Some of these components find their way into the resulting sub layer which results in the formation of creases on the subbed support film prior to coating on the subbed layer.

Thus, there is a need in the photographic art to obtain a subbing process that provides adequate adhesion between the film support and the light-sensitive layer. Additionally, the resulting photographic material must resist edge-peeling and the so-called blocking phenomenon. An object of the present invention is to provide a subbing process for light-sensitive photographic materials using, as supports, highly hydrophobic films. For example, such supports include polyesters such as polyethylene terephthalate, polyethylene-2,6-naphthalate or poly(cyclohexane-1,4-dimethanolterephthalic acid ester), cellulose esters such as cellulose diacetate or cellulose triacetate, and polycarbonate. The present subbing process eliminates the discharge of harmful organic solvent vapors and results in a material having excellent adhesion and edge-peeling resistance. Additionally, the blocking phenomenon is eliminated which occurs after coating and drying a subbing liquid on the support and before coating a subsequent layer on the subbed surface of the support.

More particularly, the present invention provides a subbing process in which edge-peeling is eliminated from a light-sensitive silver halide photograpic material comprising a hydrophobic film as support which is pretreated.

SUMMARY OF THE INVENTION

The present inventors have found that the abovementioned objects can be accomplished by subjecting the surface of a hydrophobic film, to pretreatment such as electron bombardment, ultraviolet irradiation or flame treatment and then subbing the pretreated surface of the film with an aqueous dispersion containing a copolymer comprising 20–90% by weight of a glycidyl methacrylate and/or glycidyl acrylate copolymerizable component (hereinafter referred to as "component A") and 10–60% by weight of at least one copolymerizable component (hereinafter referred to as "component B") by the formula $$CH_2{=}\underset{\underset{R_1}{|}}{C}{-}COOR_2$$

wherein $R_1$ represents a hydrogen atom or a lower alkyl group and $R_2$ represents an aliphatic hydrocarbon residue of 1 to 9 carbon atoms. Preferably, $R_2$ is a straight chain or branched alkyl group having 1 to 9 carbon atoms and when $R_1$ is a hydrogen atom, $R_2$ is a straight chain or branched alkyl group having 1 to 6 carbon atoms. When $R_1$ is a methyl group, $R_2$ is a straight chain or branched alkyl group having 5 to 9 carbon atoms, the sum of component A and component B being greater than 76% by weight (the aqueous dispersion referred to herein is called hereinafter "the aqueous copolymer dispersion of the present invention").

The present invention does not include a copolymer which comprises, as the copolymerizable components, 20–60% by weight of glycidyl methacrylate and 25–60% by weight of ethyl acrylate such that the total of said glycidyl methacrylate and ethyl acrylate is more than 76% by weight based on the copolymer. The above-mentioned excluded subject matter is found in U.S. Pat. application Ser. No. 608,273, filed Aug. 27, 1975, now abandoned, in the name of the same inventors.

A light-sensitive photographic material is obtained by forming a light-sensitive photographic layer on a support previously prepared by subjecting a hydrophobic film to pretreatment in order to render the surface hydrophilic. The pretreated surface is subbed with the aqueous copolymer dispersion of the present invention. The copolymer comprising mainly component A and component B does not discharge any harmful organic solvent vapor during preparation, and results in elimination of the blocking phenomenon, and provides excellent adhesion. In addition, a light-sensitive silver halide photographic material obtained by forming a silver halide emulsion layer on said support eliminates edge-peeling during development by an automatic developing machine.

Typical examples of the hydrophobic film used in the present invention include, for example, polyester films such as polyethylene terephthalate, polyethylene-2,6-naphthalate and poly-(cyclohexane-1,4-dimethanolterephthalic acid ester), cellulose ester films such as cellulose diacetate and cellulose triacetate, and polycarbonate films.

As mentioned previously, the aqueous copolymer dispersion of the present invention contains a copolymer comprising 20–90% by weight of component A and 10–60% by weight of component B. The sum of the amounts of component A and component B total more than 76% by weight. The copolymer may contain, as a copolymerizable component, any monomer copolymerizable with each of the aforesaid monomer units. In that case, when the amount of component B is greater than component A (see compound (1) and (2) in Table 1), it is desirable to select, as a copolymerizable component, a monomer capable of rendering the resulting copolymer relatively hard, i.e. a monomer which tends to raise the glass transition temperature. This will substantially eliminate the blocking phenomenon. For example, the copolymerizable component can be selected from vinylidene chloride, styrene, methyl methacrylate, ethyl methacrylate, butyl methacrylate, vinyl acetate, acrylonitrile or diacetone acrylamide.

When the amount of component B is less than component A and the resulting copolymer is hard, it is desirable to select a monomer as a comonomer which tends to lower the glass transition temperature of the resulting copolymer. This will prevent a decrease in adhesive strength of the sub layer. For example, the copolymerizable monomers can be selected from 2-ethylhexyl acrylate, isoprene or butadiene. The copolymerizable component is then copolymerized with components A and B.

Further, in order to stabilize the aqueous copolymer dispersion of the present invention, the copolymer contained in the dispersion may further contain less than 5% by weight (preferably less than 2% by weight) of a copolymerizable component selected, for example, from the group consisting of acrylic acid, methacrylic acid, itaconic acid, 2-sulfoethyl methacrylate and 2-sulfopropyl methacrylate.

In order to prevent the blocking phenomenon and to provide a sub layer with excellent adhesion and resistance to edge-peeling, it is necessary that the copolymer provide for a total amount of components A and B exceeding 76% by weight based on the weight of the copolymer. The copolymer contained in the aqueous copolymer dispersion is prepared according to emulsion polymerization as will be described later and hence it is obtained in the form of an aqueous dispersion of particulate emulsion polymerizate, i.e. the so-called latex. This aqueous copolymer dispersion may be prepared by charging a flask equipped with a reflux condenser and a stirrer with an emulsifier, e.g. ammonium persulfate, and a polymerization initiator, e.g. sodium hydrogen sulfite. The contents of the flask are maintained at about 60° C. with stirring. Subsequently, the appropriate mixture of copolymerizable monomers are added dropwise to the flask to effect polymerization in order to obtain the desired aqueous dispersion. The optimum amount of surface active agent used in the polymerization reaction is less than 5% by weight, especially 1% by weight based on the weight of the copolymerizable monomers.

Usually, the particle diameter of the copolymer in the resulting dispersion is preferably approximately 0.15 micron. However, the particle diameter varies depending on the synthesis conditions such as the amount of a surface active agent used, stirring conditions and polymerization temperature employed. Thus, the copolymer prepared as above is obtained in the form of an aqueous dispersion. Thus it may be used, as is, as a subbing liquid or it may be incorporated with a diluent, organic solvent, surface active agent, etc. to prepare a subbing liquid.

Shown below are examples of methods of preparation by which typical copolymers (exemplified compounds) are obtained. Comparative copolymers are also prepared by using emulsion polymerization in the same manner as the exemplified compounds. Thus, the copolymers are obtained in the form of an aqueous dispersion of a particulate emulsion polymerizate.

Method of Preparation 1

Preparation of Exemplified compounds (1)-(13), Control compounds (1) and (2) shown in Table 1

200 ml of distilled water which has been deaerated and sodium dodecylbenzenesulfonate as an emulsifier are placed into a 500 ml four-necked flask equipped with a stirrer, a reflux condenser, a temperature control type heating apparatus, a thermometer and a dropping funnel. The contents of the flask are stirred at a rate of 250 r.p.m. while heating said flask to maintain the temperature within the flask at 60° C.

0.15 G of ammonium persulfate as a polymerization initiator and 0.15 g of sodium hydrogen sulfite as a polymerization promotor are further added to the flask. Subsequently, the flask is charged with one tenth of each of the predetermined amounts of monomers indicated in Table 1 and allowed to stand for 10 minutes beginning with the initiation of polymerization. Then, the flask is charged dropwise with the remaining portions of the monomers at predetermined time intervals covering a period of 50 minutes.

Since heat is given off during addition of the monomers due to heat of polymerization, the flask is cooled so that the temperture within said flask is constantly maintained at 60° C. After adding all of the monomers, the polymerization is almost complete when the reaction is continued for an additional period of 4 hours. Each of the copolymers thus prepared is in the form of an aqueous dispersion of a particulate emulsion-polymerizate. The concentration of solids in the dispersion is within the range from 32 to 33% by weight, the surface tension of the dispersion as measured at 25° C. is within the range from 45 to 52 dyne/cm, the rate of polymerization is at least 96%, and the particle diameter of the polymerizate as measured by an electron microscope is in the vicinity of 0.12 micron.

Each of the copolymers obtained was measured to determine the content of epoxy groups which fell within the range of from 96 to 100% based on the calculated value of the epoxy group content obtained from the amount of glycidyl methacrylate or glycidyl acrylate charged. This measurement indicates that the hydrolysis reaction of glycidyl methacrylate or glycidyl acrylate during copolymerization can be for practical purposes ignored. Since each of the copolymers (aqueous dispersions) thus prepared has a pH value of about 4, the copolymer was used after adjusting the pH value to 7 with the additional of a small amount of 1N ammonia water.

Table 1

| Copolymer (aqueous dispersion) obtainable by preparative method 1 | Comonomer used | Amount of comonomer used (wt. %) |
|---|---|---|
| | Glycidyl acrylate | 20 |
| Exemplified compound (1) | Ethyl acrylate | 60 |
| | Vinylidene chloride | 20 |
| | Glycidyl methacrylate | 20 |
| Exemplified compound (2) | Methyl acrylate | 20 |
| | Vinylidene chloride | 60 |
| | Glycidyl methacrylate | 30 |
| Exemplified compound (3) | Propyl acrylate | 40 |
| | Acrylonitrile | 30 |
| | Glycidyl acrylate | 40 |
| Exemplified compound (4) | Ethyl acrylate | 59.5 |
| | 3-Sulfopropyl methacrylate | 0.5 |
| Exemplified compound (5) | Glycidyl acrylate | 50 |
| | Ethyl acrylate | 50 |
| | Glycidyl methacrylate | 50 |
| Exemplified compound (6) | Methyl acrylate | 10 |
| | Butyl methacrylate | 40 |
| Exemplified compound (7) | Glycidyl methacrylate | 50 |
| | Pentyl methacrylate | 50 |
| | Glycidyl methacrylate | 50 |
| Exemplified compound (8) | Butyl acrylate | 30 |
| | Styrene | 20 |
| | Glycidyl acrylate | 30 |
| Exemplified compound (9) | Glycidyl methacrylate | 30 |
| | Hexyl methacrylate | 40 |
| Exemplified compound (10) | Glycidyl acrylate | 70 |
| | Nonyl methacrylate | 30 |
| | Glycidyl methacrylate | 70 |
| Exemplified compound (11) | Ethyl acrylate | 10 |
| | 2-Ethylhexyl acrylate | 20 |
| Exemplified compound (12) | Glycidyl methacrylate | 75 |
| | Ethyl acrylate | 25 |
| Exemplified compound (13) | Glycidyl acrylate | 90 |
| | Hexyl acrylate | 10 |
| | Glycidyl methacrylate | 10 |
| Control compound (1) | Ethyl acrylate | 30 |
| | Vinylidene chloride | 60 |
| Control compound (2) | Glycidyl methacrylate | 100 |

Method of Preparation 2

Preparation of Control compound (3), i.e. vinylidene chloride/vinyl chloride/n-butyl acrylate/itaconic acid copolymer (an aqueous dispersion)

200 ml of distilled water which has been deaerated and 1 g of sodium dodecylbenzenesulfonate as an emulsifier was placed in the same type of flask used in Method of Preparation 1. The contents of the flask were heated so as to maintain the temperature within said flask at 45° C. and stirred at a rate of 150 r.p.m. 0.3 g of ammonium persulfate as a polymerization initiator and 0.15 g of sodium hydrogen sulfite as a polymerization promotor were added to the flask. Then, a monomer mixture comprising 30 g of vinylidene chloride, 63 g of vinyl chloride, 5 g of n-butyl acrylate and 2 g of itaconic acid were added dropwise through the dropping funnel at predetermined time intervals covering a period of 2 hours.

Since heat is given off during addition of the monomer mixture due to heat of polymerization, the flask is cooled to permit mild boiling of the monomers. After addition of the monomers is completed, the reaction is carried out at the temperature of 45° C. within the flask for 1 hour and then for an additional hour after elevating the temperature within the flask to 70° C. This permits the polymerization reaction to proceed to near completion. The copolymer (aqueous dispersion) thus prepared has a concentration of solids of 33% by weight, a rate of polymerization of 99%, a particle diameter 0.15 micron and a pH value of 2. The dispersion was used, however, after adjusting the pH value to 7 with the addition of a small amount of 1N ammonia water.

After adjustment of the pH value, the dispersion had a surface tension as measured at 25° C. of 48 dyne/cm.

Method of Preparation 3

Preparation of Control compound (4), i.e. butadiene/styrene/itaconic acid copolymer (aqueous dispersion)

The starting material (shown below) is placed into a 100 ml pressure ampule for polymerization. The ampule is then completely sealed. The ampule is placed in a shaking type thermostat wherein the temperature therein is constantly maintained at 60° C., and the ampule is vibrated at 100 times per minute.

| | |
|---|---|
| Deaerated distilled water | 50 ml |
| Sodium dodecylbenzenesulfonate | 0.25 g |
| Ammonium persulfate | 0.200 g |
| Butadiene | 10 g |
| Styrene | 15 g |
| Itaconic acid | 1 g |

The polymerization reaction is continued for 5 hours in the above manner to obtain a copolymer (an aqueous dispersion). The concentration of solids in the dispersion is 32% by weight, the rate of polymerization is 95%, and the particle diameter of the copolymer is 0.11 micron.

An immaterial amount of an aggregate was found to have adhered to the inside wall of the ampule. The copolymer dispersion had a pH value of 2.1 immediately after being taken out from the ampule. When the dispersion was used the pH was adjusted to a value of 7 with the addition of a small amount of 1N ammonia water. After the pH adjustment, the copolymer dispersion had a surface tension of 48 dyne/cm.

When a hydrophobic film for use in a light-sensitive photographic material is subjected to a subbing treatment with an aqeuous copolymer dispersion of the present invention, the surface of the hydrophobic film is previously made hydrophilic by treatment with a treating liquid containing an oxidizing agent. The surface of the film can also be made hydrophilic by corona discharge or by ultraviolet irradiation by means of a low, medium or high pressure mercury lamp. Finally, flame spraying can also be used for this purpose.

Subsequently, the pretreated film may be coated on the pretreated surface with, for example, a copolymer in the form of an aqueous dispersion prepared according to the procedure shown in Method of Preparation 1 as a subbing liquid which may be incorporated, if necessary, with various additives such as diluents, organic solvents, plasticizers, water-soluble polymers, adhesion promoting agents, surface active agents, anti-blocking agents or dyes for antihalation purposes, or dyes or pigments for film base coloring.

As examples of additives mentioned above, there may be used an agent which promotes drying for a subbing layer such as methyl alcohol, ethyl alcohol or acetone; a solvent for improving the formability of the subbing layer such as methyl ethyl ketone, dioxane or ethyl acetate; a so-called temporary plasticizer like such high boiling solvents as cyclohexanone, butyl cellosolve or benzyl alcohol. The temporary plasticizer permeates among particles present in the aqueous copolymer dispersion to plasticize the copolymer and thereby faciliate adhesion among the particles and improve the ability to form a film. These solvents may be removed by evaporation in the subsequent step of drying or heat treatment.

Additional additives include a commonly used plasticizer such as dibutyl phthalate or dioctyl phthalate and a water soluble polymer for neatly finishing a layer formed by coating the subbing liquid on the film surface. Examples of the water soluble polymer include polyvinyl alcohol, carboxymethyl cellulose, vinyl acetate/maleic acid copolymer gelatin or casein. A compound having an ethyleneimino group or a compound having a methylsulfonyloxy group can be used as an adhesion promoting agent. As the surface active agent which is incorporated into the subbing liquid to improve coating, there may be used, for example, such anionic surface active agents as sodium dodecylbenzenesulfonate or sodium laurylsulfate, a nonionic surface active agent, such as sorbitane alkylester or polyoxyethylene alkylether. An amphoteric surface active agent such as an alkylmetal salt of dialkylbenzenepolyoxyethylene-sulfonic acid, or a natural surface active agent such as saponin can be used in combination with the anionic surface active agents.

The amount of the surface active agent incorporated into the subbing liquid may be the same as used in preparing the aqueous copolymer dispersion of the present invention. However, the subbing liquid may be suitably incorporated, when used in the subbing treatment, with an additional amount of the surface active agent in order to further improve the coating.

In addition, a particulate material may be incorporated into the subbing liquid as an anti-blocking agent. Such materials include silicon oxide, titanium oxide, zinc oxide, aluminum oxide, polymethyl methacrylate, polystyrene or starch.

The coating methods employed in the present invention include dip coating, double roll coating, blade coating, airknife coating, kiss roll coating or gravure roll coating. The coated sub layer is dried by heating at 60° C to 150° C. by means of a parallel or vertical stream of hot air or infrared irradiation. The aqueous copolymer dispersion of the present invention is coated on a hydrophobic film to form a sub layer so that the sub layer has a dry weight ranging from 0.05 to 5 g/m$^2$.

The support film thus obtained may be subjected, if necessary, to heat treatment at 100°-180° C. Alternatively, the film support thus treated may be further coated on the sub layer thereof with a hydrophilic polymer layer such as disclosed in Japanese Patent Publication No. 24159/1971, Japanese Laid-Open-to-Public Publication No. 91165/1973 and Japanese Patent Publication No. 23828/1974, or a gelatin layer as a second layer having a dry weight of 0.05 to 5 g/m$^2$ and, thereafter, the resulting support film is further subjected to heat treatment at 100° to 180° C.

When using a second sub layer, various additives used for the first sub layer can be employed for the second sub layer. These layers may be incorporated to prevent blocking, improve adhesion and to prevent static. Examples of these additives include, an ethyleneimino group containing compound, a compound having a methylsulfonyloxy group, and a particulate material such as titanium oxide, silicon oxide, colloidal silica, zinc oxide, aluminum oxide, polymethyl methacrylate, polystyrene and starch. A particularly excellent adhesion is obtained between the first layer and second sub layer when colloidal silica is incorporated into the first layer. When a copolymerizate present in the first sub layer of the present invention is relatively hard as in exemplified compounds (12) or (13), the second sub layer preferably contains colloidal silica.

The layer obtained from colloidal silica as referred to above means a dry layer formed by coating a subbing composition comprising colloidal silica alone or in combination with a water-soluble high molecular weight material on the first sub-layer. Examples of the latter material include gelatin, casein, polyvinyl alcohol, carboxymethyl cellulose or vinyl acetate/maleic acid copolymer. Additionally, the colloidal silica can be combined with the aforesaid surface active agents or a material which may be used as an additive in the second sub layer for the prevention of blocking, improvement of adhesion, for the prevention of static. The total amount of silicic anhydride and sodium oxide contained in said dry layer is within the range from 0.05 to 5 g/m$^2$, preferably from 0.1 to 2 g/m$^2$. The colloidal silica used herein contains 0.1 to 2.5% by weight of sodium oxide ($Na_2O$) based on silicic anhydride ($SiO_2$). The particle diameter of the colloidal silica is less than 0.1 micron, preferably less than 0.05 micron. Examples of the colloidal silica include commercially available products such as Snowtex 20, Snowtex 30, Snowtex C, Snowtex N and Snowtex O (products produced and sold by Nissan Kagaku Kogyo K.K.) and Ludox (a product produced and sold by Du Pont Co.).

The support film thus subbed may be coated on the sub layer according to the usual procedure with a variety of compositions for forming a light-sensitive photographic layer. Such compositions include silver halide photographic emulsions, diazo type light-sensitive compositions, photographic gelatinous compositions containing antihalation agents and gelatinous backing compositions for regulating a curl balance of support film. The light-sensitive photographic material obtained in the above manner has excellent adhesion and even when subjected to photographic treatment such as developing treatment, the light-sensitive photographic layer formed thereon does not peel off the support film.

More specifically, edge-peeling is eliminated when a light-sensitive silver halide photographic material prepared in the above manner is subjected to development by means of an automatic developing apparatus. Further, the use of a support film subbed in accordance with the present invention does not have an adverse effect on the photographic properties of the silver halide in the resulting photographic material.

The examples shown below are for illustrative purposes only and are not meant to limit or in any way redefine the invention as claimed in the claims appended hereto.

Example 1

Biaxially stretched polyethylene terephthalate films, each having a thinkness of 180 $\mu$, were individually treated on the surface by use of a corona discharge apparatus (Lepel HFSG-Model 2) under such discharge conditions as a film travelling speed of 15 m/min, electrode spacing of 1.5 mm, electric power of 200W and current flow of 0.7A. The polyethylene terephthalate film treated under the abovementioned conditions had a surface whose contact angle with water was 45°.

Subsequently, compounds (1), (3) and (5) were individually diluted with water so that the concentration of solids became 25% by weight. 20% by weight of saponin and 3% by weight based on the weight of the solids of 1,3-dimethylsulfoxypropane were added thereto. The aqueous copolymer dispersions thus obtained each had a surface tension of 45–50 dyne/cm. Eachof the aqueous copolymer dispersions was coated as a subbing liquid on the surface of each of the aforesaid polyethylene terephthalate films treated by corona discharge. Then, the films were dried by hot air at 120° C. for 3 minutes to form a sub layer. The thus formed sub layer, after drying, was found to have a thickness of 0.4–0.5g/m$^2$.

Further, the aforesaid first sub layer was coated on the surface by means of a double roll coater with a subbing liquid consisting of 0.5 wt.% aqueous gelatin solution incorporated with 0.03% by weight of saponin or a subbing liquid consisting of a 5 wt.% aqueous gelatin solution, 2.5 ml of Snowtex 20 and 0.03% by weight of saponin, and then dried for 3 minutes by use of hot air kept at 100° C. to form a second sub layer. The thus formed layer, after drying, was found to have a thickness of 0.1–0.15 g/m$^2$.

Each of the polyethylene terephthalate films thus coated with the first sub layer and then with the second sub layer and each of the polyethylene terephthalate films coated with the first sub layer only were individually coated on the subbed surface with a roentgen silver halide photographic emulsion containing silver iodobromide and then dried to prepare samples (sample Nos. 1–9). Separately, control compounds (1) and (3) were individually used in the same manner as above to prepare control samples (sample Nos. 10–15).

Each of the samples and control samples thus obtained was subjected to a film adhesion test according to the below-mentioned procedures (a), (b) and (c) as well as to and edge-peeling test according to the below-mentioned procedure (d). Separately, each of the samples and control samples, prior to coating, with the silver halide emulsion was subjected to a blocking test on the subbed surface according to the below-mentioned procedure (e). The results obtained in each test are set forth in Table 2.

(a) Dry film adhesion test before development treatment

The silver halide emulsion layer surface of each sample was scratched with a razor to form squares so that the scratch just reaches the surface of the film support. Subsequently, a cellophane adhesive tape was applied using finger pressure onto said surface and then quickly stripped off therefrom. The residual ratio of the silver halide emulsion layer on the film support to the adhesion surface area of the tape was determined as a percentage.

(b) Wet film adhesion test during development treatment

In a developing bath, the silver halide emulsion layer surface of each sample was scratched while wet with a gimlet-like tip of a metal bar to form squares and then rubbed. The residual ratio of the emulsion layer on the film support was determined as a percentage.

(c) Dry adhesion test after development treatment

After treating with a developer and fixer, followed by water-washing and drying, each sample was subjected to an adhesion test according to the procedure (a). The residual ratio of the emulsion layer on the film support to the adhesion surface area of the adhesive tape was determined as a percentage. (d) Edge-peeling test during development treatment During treatment with a developer and fixer, edges of the light-sensitive layer of each sample while wet were rubbed strongly inward with a finger or piece of soft rubber horizontally and perpendicular to each edge. If the sample suffered even slightly from edge-peeling the sample was graded "poor". If there wasn't any edge-peeling, the sample was graded "good".

(e) Blocking test

In the case where the blocking phenomenon resulted in creases formed on a subbed support film of each sample when the support film was rolled up, said sample was graded as "poor" and if there weren't any creases formed, the sample was graded "good".

Table 2

| First sub layer | Second sub layer | Sample No. | Blocking test | Edge-peeling test | Film adhesion test: Dry film adhesion before development (%) | Film adhesion test: Wet film adhesion (%) | Film adhesion test: Dry film adhesion after development (%) |
|---|---|---|---|---|---|---|---|
| Exemplified compound (1) | None | 1 | Good | Good | 80 | 90 | 70 |
| | Gelatin layer | 2 | " | " | 90 | 100 | 80 |
| | Layer obtained from colloidal silica | 3 | " | " | 100 | 100 | 90 |
| Exemplified compound (3) | None | 4 | " | " | 80 | 100 | 80 |
| | Gelatin layer | 5 | " | " | 90 | 100 | 90 |
| | Layer obtained from colloidal silica | 6 | " | " | 100 | 100 | 100 |
| Exemplified compound (5) | None | 7 | " | " | 80 | 100 | 80 |
| | Gelatin layer | 8 | " | " | 90 | 100 | 90 |
| | Layer obtained from colloidal silica | 9 | " | " | 100 | 100 | 100 |
| Control compound (1) | None | 10 | " | Poor | 50 | 50 | 40 |
| | Gelatin layer | 11 | " | " | 60 | 60 | 50 |
| | Layer obtained from colloidal silica | 12 | " | " | 80 | 80 | 70 |
| Control compound (3) | None | 13 | Poor | " | 50 | 0 | 30 |
| | Gelatin layer | 14 | Good | " | 50 | 20 | 40 |
| | Layer obtained from colloidal silicat | 15 | " | 4 | 80 | 70 | 70 |

Table 2 shows that the polyethylene terephthalate film support coated with the aqueous copolymer dispersion of the present invention used as a subbing liquid is excellent because of its superior adhesion and lack of edge-peeling, as compared with the polyethylene terephthalate film support coated with the aqueous copolymer dispersion using as a subbing liquid. Additionally, the samples of the present invention are quite excellent in their overall characteristics.

It is also understood that adhesion can be further improved by coating a subbed film support with a second sub layer containing colloidal silica.

It is well known in this field of the art that sufficient adhesion for practical use is achieved when the value thereof as measured according to emulsion film adhesion test conducted in these examples is at least 70%.

Example 2

The surface of cellulose triacetate films were individually irradiated for 15 minutes at a distance of 2 cm from the light source using a 400W low pressure mercury lamp having main wavelength of 2537A. The irradiation was effected in the atmosphere of 25° C. and 55% RH.

Subsequently, each of compounds (3), (8) and (10) was diluted with water so that the concentration of solids became 10% by weight to thereby prepare an aqueous copolymer dispersion of the present invention. The surface of each of the cellulose triacetate films pretreated as above was coated by use of an air knife coater with each of the aqueous copolymer dispersions thus prepared. Then, the surfaces were dried by means of hot air at 85°–90° C. for 2 minutes to form a sub layer. The dry layer thus formed had a thickness of 0.8–1.0 g/m$^2$. The thus formed sub layer was further coated by use of an air knife coater with a 1.0 wt.% aqueous gelatin solution incorporated with 3% by weight of saponin based on the weight of gelatin. Then the sub layer was dried by means of hot air at 85–90° C. for 2 minutes to form a second sub layer. The dry gelatin layer thus obtained had a thickness of 0.2–0.25 g/m$^2$.

Separately, a subbing liquid was prepared by incorporating 6 ml of Snowtex 30 into the subbing liquid used for forming the aforesaid second sub layer and the resulting subbing liquid was coated likewise on the first sub layer. Further, each of the thus prepared cellulose triacetate film supports and each of the cellulose triacetate film supports having only the first sub layer prepared were subjected to heat treatment for 15 seconds by use of a hot roller. The resulting subbed film supports were individually coated on the subbed layer surface with a photographic emulsion containing silver chlorobromide for microphotography to prepare samples (samples Nos. 16–24). Separately, control compounds (1), (3) and (4) were likewise individually used to prepare control samples (samples Nos. 25–30).

Subsequently, the thus prepared samples and control samples were individually subjected in the same manner as in Example 1 to the film adhesion test as well as the edge-peeling test. Separately, the samples and control samples, prior to coating with the silver halide emulsion, were individually subjected to the blocking test on the sub layer. The results are shown in Table 3.

Table 3

| First sub layer | Second sub layer | Sample No. | Blocking test | Edge-peeling test | Film adhesion test: Dry film adhesion before development (%) | Film adhesion test: Wet film adhesion (%) | Film adhesion test: Dry film adhesion after development (%) |
|---|---|---|---|---|---|---|---|
| Exemplified compound (4) | None | 16 | Good | Good | 80 | 100 | 70 |
| | Gelatin layer | 17 | " | " | 90 | 100 | 90 |
| | Layer obtained from colloidal silica | 18 | " | " | 100 | 100 | 100 |
| Exemplified compound (8) | None | 19 | " | " | 80 | 100 | 80 |
| | Gelatin layer | 20 | " | " | 90 | 100 | 80 |
| | Layer obtained from colloidal silica | 21 | " | " | 100 | 100 | 100 |
| Exemplified compound (10) | None | 22 | " | " | 70 | 100 | 70 |
| | Gelatin layer | 23 | " | " | 80 | 100 | 70 |
| | Layer obtained from colloidal silica | 24 | " | " | 100 | 100 | 100 |
| Control compound (2) | None | 25 | " | " | 0 | 80 | 0 |
| | Gelatin layer | 26 | " | " | 20 | 80 | 0 |
| | Layer obtained from colloidal silica | 27 | " | " | 50 | 80 | 50 |
| Control compound (4) | None | 28 | Poor | Poor | 40 | 10 | 40 |
| | Gelatin layer | 29 | Good | " | 60 | 10 | 50 |
| | Layer obtained from colloidal silica | 30 | " | " | 80 | 30 | 70 |

Table 3 shows that the cellulose triacetate film support coated with the aqueous copolymer dispersion of the present invention used as a subbing liquid is excellent in overall characteristics with respect to edge-peeling, adhesion and blocking, as compared with the cellulose triacetate film support coated with the control aqueous copolymer dispersion used as a subbing liquid.

It is further understood that better adhesion can be obtained by further coating the first subbed film support with a layer containing colloidal silica which is used as the second sub layer.

Example 3

Biaxially stretched polyethylene terephthalate films, each having a thickness of 100μ, were individually irradiated on the surface by use of a 400W low pressure mercury lamp having the main wavelength of 2537A for 15 minutes at the distance of 2 cm from the light source. The irradiation was effected in the atmosphere of 25° C. and 55% RH. Each of the films treated under the above-mentioned conditions had a surface whose contact angle with water was 55°.

Subsequently, each of the compounds (2), (4), (6) and (7) was diluted with water so that the concentration of solids became 10% by weight to thereby prepare an aqueous copolymer dispersion of the present invention. Each aqueous copolymer dispersion thus prepared was coated as a subbing liquid by use of an air knife coater on the polyethylene terephthalate film surface, which has previously been rendered hydrophilic by pretreatment in the above manner and then dried by means of hot air at 80–90° C. for 2 minutes to form a first sub layer. The dry layer thus obtained had a thickness of 0.8–1.0g/m$^2$. The thus formed first sub layer was coated by use of an air knife coater with a 1.0 wt.% aqueous gelatin solution incorporated with 3% by weight of saponin based on the weight gelatin and then dried over hot air at 85°–90° C. for 2 minutes to form a second sub layer. The thus obtained dry gelatin layer had a thickness of 0.2–0.25 g/m$^2$. Each of the subbed films was subjected to heat treatment for 1 minute by use of a hot roller having a surface temperature of 150° C. and then coated on the sub layer surface with a lith type silver halide photographic emulsion containing silver chlorobromide to prepare samples (samples Nos. 31, 32, 33 and 34). Separately, control compounds (1) and (4) were individually used in the same manner as above to prepare control samples (samples Nos. 35 and 36).

Subsequently, the samples and control samples thus prepared were individually subjected to the film adhesion test as well as the edge-peeling test according to the same procedure as in Example 1. Separately, the samples and control samples, prior to coating with the silver halide emulsion, were individually subjected to the blocking test on the first sub layer. The test results are shown in Table 4.

Table 4

| First sub layer | Sample No. | Blocking test | Edge-peeling test | Film adhesion test: Dry film adhesion before development (%) | Wet film adhesion (%) | Dry film adhesion after development (%) |
|---|---|---|---|---|---|---|
| Exemplified compound (2) | 31 | Good | Good | 80 | 85 | 80 |
| Exemplified compound (4) | 32 | " | " | 90 | 100 | 90 |
| Exemplified compound (6) | 33 | " | " | 100 | 100 | 90 |
| Exemplified compound (9) | 34 | " | " | 100 | 100 | 100 |
| Control compound (1) | 35 | " | " | 60 | 80 | 50 |
| Control compound (4) | 36 | " | Poor | 90 | 80 | 80 |

Table 4 shows that the polyethylene terephthalate film support coated with the aqueous copolymer dispersion of the present invention used as a subbing liquid is excellent in overall characteristics including the elimination of edge-peeling. Additionally, adhesion is improved and blocking is prevented as compared with the polyethylene terephthalate film support coated with the control aqueous copolymer dispersion used as a subbing liquid.

Example 4

Biaxially stretched polyethylene terephthalate films, each having a thickness of 100μ were individually treated to render the surface thereof hydrophilic according to the procedure as described in Example 1. Separately, compounds (7), (9) and (10) were individually diluted with water according to Example 1 and then incorporated with saponin and 1,3-dimethylsulfoxypropane to obtain aqueous copolymer dispersions. Each of the aqueous copolymer dispersions of the present invention thus obtained had a surface tension of 45–50 dyne/cm. This aqueous copolymer dispersion was coated as a subbing liquid on the aforesaid hydrophilic surface of the polyethylene terephthalate film according to Example 1 and then dried to form a sub layer The thus obtained dry layer had a thickness of 0.4–0.5 g/m$^2$.

Further, a subbing liquid of the following formulation was coated on the first sub layer by use of a double roll coater and then dried by means of hot air at 100° C. for 3 minutes to form a second sub layer. The dry layer thus formed had a thickness of 0.5–0.6 g/m$^2$.

| | |
|---|---|
| Snowtex 20 | 100 ml |
| Gelatin | 5 g |
| Sodium di-n-octylbenzenedodecylsulfonate | 0.2 g |
| Water | 900 ml |

The thus obtained polyethylene terephthalate films coated with the second sub layer were individually coated on the subbed surface with a backing gelatinous composition for gravure film to prepare samples (samples Nos. 37, 38 and 39). Separately, the control compounds (3) and (4) were individually used in a similar manner to prepare control samples (samples Nos. 40 and 41). Subsequently, the thus prepared samples and control samples were individually subjected to the film adhesion test as well as the edge-peeling test according to the same manner as in Example 1. Separately, the samples and control samples were individually subjected to the blocking test according to the procedure described in Example 1 after coating and drying the first sub layer and before coating the second sub layer. The test results are shown in Table 5.

Table 5

| First sub layer | Sample No. | Blocking test | Edge-peeling test | Film adhesion test: Dry film adhesion before development (%) | Wet Film adhesion (%) | Dry film adhesion after development (%) |
|---|---|---|---|---|---|---|
| Exemplified compound (7) | 37 | Good | Good | 90 | 100 | 90 |
| Exemplified compound (9) | 38 | Good | Good | 100 | 100 | 90 |
| Exemplified compound (10) | 39 | Good | Good | 90 | 100 | 80 |
| Control compound (3) | 40 | Poor | Poor | 90 | 100 | 80 |
| Control compound (4) | 41 | Good | Poor | 70 | 80 | 60 |

Table 5 shows that the polyethylene terephthalate film support coated with the aqueous copolymer dispersion of the present invention used as a subbing liquid suffers no edge-peeling as compared with the polyethylene terephthalate film support coated with the control aqueous copolymer dispersion used as a subbing liquid. Also, the present film shows excellent adhesion and is not affected by the blocking phenomenon.

Example 5

Cellulose triacetate films, each havng a thickness of 120 μ, were individually treated to render the surface thereof hydrophilic according to the procedure described in Example 1. In the same manner as in Example 1, each of compounds (1), (3) and (5) was diluted with water and then incorporated with saponin and 1,3-dimethylsulfoxypropane to prepare an aqueous copolymer dispersion. Each of the aforesaid treated cellulose triacetate films was coated according to the same manner as in Example 1 with the aqueous copolymer dispersion and then dried to form a first sub layer. The thus obtained dry layer had a thickness of 0.4–0.5 g/m$^2$. Further, a subbing liquid of the following composition was coated by means of a double roll coater on the first sub layer and then dried to form a second sub layer. The thus formed layer after drying had a thickness of 0.1–0.15 g/m$^2$.

| | |
|---|---|
| Gelatin | 5 g |
| 10% Formalin | 15 ml |
| Water | 1000 ml |

The thus obtained cellulose triacetate films coated with the second sub layer were individually coated on the subbed surface with a monochromatic silver iodobromide photographic emulsion to prepare samples (samples Nos. 42, 43 and 44). Separately, the control compounds (1) and (3) were individually used in the same manner as above to prepare control samples (samples Nos. 45 and 46).

Subsequently, the thus prepared samples and control samples were individually subjected to the same manner as in Example 1 to the film adhesion test and edge-peeling tests. Separately, the samples and control samples were individually subjected to the blocking test in the same manner as in Example 1 after coating and drying the first sub layer and before coating the second sub layer. The test results are shown in Table 6.

Table 6

| First sub layer | Sample No. | Blocking test | Edge-peeling test | Film adhesion test: Dry film adhesion before development (%) | Wet film adhesion (%) | Dry film adhesion after development (%) |
|---|---|---|---|---|---|---|
| Exemplified compound (1) | 42 | Good | Good | 80 | 100 | 80 |
| Exemplified compound (3) | 43 | " | " | 90 | 100 | 80 |
| Exemplified compound (5) | 44 | " | " | 100 | 100 | 90 |
| Control compound (1) | 45 | " | Poor | 50 | 80 | 40 |
| Control compound (3) | 46 | Poor | " | 80 | 90 | 50 |

Table 6 shows that even when a cellulose triacetate film is used as a support which has been subjected to corona discharge treatment and then coated with a gelatin layer as a second sub layer, the pretreated support of the present invention is excellent in overall characteristics. More specifically, the present support provides for the elimination of edge-peeling, and the blocking phenomenon and excellent adhesion.

Example 6

Biaxially stretched polyethylene terephthalate films, each having a thickness of 180 $\mu$, were individually pretreated according to the procedure described in Example 2 to render the surface thereby hydrophilic. The thus pretreated surface of each of the polyethylene terephthalate films had a contact angle with water of 55°.

Subsequently, each of compounds (8), (11), (12) and (13) was diluted with water so that the concentration of solids became 10% by weight to thereby prepare an aqueous copolymer dispersion of the present invention. This dispersion was coated according to the procedure of Example 2 on the aforesaid pretreated surface of each polyethylene terephthalate film and then dried to form a first sub layer. The thus obtained dry layer had a thickness of 0.8–1.0 g/m$^2$. The first sub layer thus formed was further coated by means of a double roll coater with a subbing liquid of the following composition and then dried by means of hot air at 100° C. for 3 minutes to form a second sub layer. The thus obtained dry layer was 1.0 g/m$^2$ thick.

| | |
|---|---|
| Snowtex 30 | 100 ml |
| Milk casein | 3 g |
| Saponin | 0.2 g |
| Water | 900 ml |

The thus obtained polyethylene terephthalate films, each coated with the second sub layer, were individually coated on the sub layer surface with a gelatinous composition for cut film used in color photography to prepare samples (samples Nos. 47–50). Separately, control samples (samples Nos. 51 and 52) were prepared by use of control compounds (2) and (3), respectively, in the same manner as above.

Subsequently, the thus prepared samples and control samples were individually subjected according to the same procedure as in Example 1 to the film adhesion and edge-peeling tests. Separately, the samples and control samples were individually subjected to the blocking test after coating the first layer and before coating the second layer. The test results are shown in Table 7.

Table 7

| First sub layer | Sample No. | Blocking test | Edge-peeling test | Film adhesion test: Dry film adhesion before development (%) | Wet film adhesion (%) | Dry film adhesion after development (%) |
|---|---|---|---|---|---|---|
| Exemplified compound (8) | 47 | Good | Good | 80 | 100 | 80 |
| Exemplified compound (11) | 48 | " | " | 100 | 100 | 90 |
| Exemplified compound (12) | 49 | " | " | 100 | 100 | 100 |
| Exemplified compound (13) | 50 | " | " | 80 | 100 | 80 |
| Control compound (2) | 51 | " | " | 20 | 100 | 0 |
| Control compound (3) | 52 | Poor | Poor | 80 | 100 | 80 |

Table 7 shows that even when the biaxially stretched polyethylene terephthalate film, having a thickness of 180 $\mu$, is used as a support, the support coated with the aqueous copolymer dispersion of the present invention is excellent in that it eliminates edge-peeling, provides excellent adhesion, and eliminates the blocking phenomenon, as compared with the support coated with the control aqueous copolymer dispersion.

Example 7

Biaxially stretched and blue colored polyethylene terephthalate films, each having a thickness of 180 $\mu$, were individually pretreated according to the procedure described in Example 1 to render the surfaces thereof hydrophilic. The thus pretreated surface of each polyethylene terephthalate film had a contact angle with water of 45°.

Subsequently, each of compounds (2), (5) and (11) was diluted with water so that the concentration of solids became 5% by weight to thereby prepare an aqueous copolymer dispersion. The thus prepared dispersion was incorporated, based on the weight of the solids, with 1% by weight of saponin, 5.0% by weight of hexamethylene-bis(N,M-ethyleneurea) and 0.01% by weight of silicon oxide having a particle size of 3–5 μ, to prepare a dispersion as a subbing liquid. The thus prepared subbing liquid was coated by means of a double roll coater on the aforesaid pretreated surface of each polyethylene terephthalate film and then dried by means of hot air at 120° C. for 30 seconds to form a sub layer. The dry layer thus formed was about 0.55 to about 0.75 g/m$^2$ in thickness. Subsequently, the thus formed sub layer was coated by means of a double roll coater with a 0.5 wt.% aqueous solution of a compound of Synthesis Example 1 disclosed in Japanese Patent Publication No. 24159/1971 and then dried by means of hot air at 85°–90° C. for 1 minute to form a sub layer. The dry layer thus formed was about 0.1 g/m$^2$ thick.

Subsequently, the surfaces of the sub layers thus formed were each subjected to heat treatment in hot air at 130° C. for 5 minutes and then coated with a roentgen silver halide photographic emulsion containing silver iodobromide to prepare samples (samples Nos. 53, 54 and 55).

Separately, control samples (samples Nos. 56 and 57) were prepared in the same manner as above, except that the control compounds (1) and (2) were used. Subsequently, the samples and control samples thus prepared were individually subjected, according to the same procedure as in Example 1, to the film adhesion and edge-peeling tests. Separately, the samples and control samples were individually subjected to the blocking test before coating the second layer. The test results are shown in Table 8.

Table 8

| First sub layer | Sample No. | Blocking test | Edge-peeling test | Film adhesion test: Dry film adhesion before development (%) | Wet film adhesion (%) | Dry film adhesion after development (%) |
|---|---|---|---|---|---|---|
| Exemplified compound (2) | 53 | Good | Good | 80 | 100 | 80 |
| Exemplified compound (5) | 54 | " | " | 100 | 100 | 100 |
| Exemplified compound (11) | 55 | " | " | 100 | 100 | 80 |
| Control compound (1) | 56 | " | Poor | 80 | 100 | 70 |
| Control compound (2) | 57 | " | Good | 0 | 50 | 0 |

Table 8 shows that the polyethylene terephthalate film support coated with the aqueous copolymer dispersion of the present invention used as a subbing liquid provides excellent adhesion and prevents both edge-peeling and blocking as compared with the polyethylene terephthalate film support coated with the control aqueous copolymer dispersion used as a subbing liquid.

Example 8

Biaxially stretched polyethylene terephthalate films, each having a thickness of 100 μ, were individually pretreated according to the procedure described in Example 1 to impart the surface thereof hydrophilic. Subsequently, each of compounds (1), (3) and (5) was diluted in the same manner as in Example 1 with water and then incorporated with saponin and 1,3-dimethylsulfoxypropane to prepare an aqueous copolymer dispersion. The thus obtained copolymer dispersion was coated and dried according to the same procedure as in Example 1 on the aforesaid pretreated surface of each polyethylene terephthalate film to form a sub layer. The thus formed dry layer was 0.4–0.5 g/m$^2$ thick.

The polyethylene terephthalate films coated with the thus obtained sub layer were individually coated on the sub layer surface with a diazonium light-sensitive liquid of the following formulation in a coating amount of 50 ml/m$^2$ to prepare samples (samples Nos. 58, 59 and 60). Separately, control samples (samples Nos. 61 and 62) were individually prepared in the same manner as above.

| Formulation of diazonium light-sensitive liquid: | |
|---|---|
| 2,5-Diethoxy-4-morpholinobenzenediazonium tetrafluoroborate | 1.0 g |
| 3-Hydroxy-2-naphthoic acid ethanolamide hydrochloride | 1.5 g |
| Cellulose acetate butylate | 5.0 g |
| Sulfosalicyclic acid | 0.5 g |
| Citric acid | 0.5 g |
| Zinc chloride | 0.2 g |
| Ethylene chloride | 60 ml |
| Ethyl alcohol | 30 ml |
| Dioxane | 10 ml |

Subsequently, the thus prepared samples and control samples were individually tested in film adhesion efficiency according to procedure (a) dry film adhesion test before development treatment and the procedure (c) dry film adhesion test after development treatment, respectively, as set forth in Example 1. The tests are shown in Table 9.

Example 9

Polycarbonate films used as supports, each having a thickness of 100 μ were individually pretreated in the same manner as in Example 8 to render the surface thereof hydrophilic. Compounds (3), (6) and (11) and control compounds (1) and (2) were individually used in exactly the same manner as in Example 8 to prepare their respective subbing liquids. Each polycarbonate film support was coated on the pretreated surface with each subbing liquid to form a first sub layer, and then coated on the first sub layer with the same diazonium light-sensitive liquid and in the same manner as in Example 8 to prepare samples (samples Nos. 63, 64 and 65), and control samples (samples Nos. 66 and 67). Subsequently, the samples and control samples thus prepared were individually subjected according to exactly the same manner as in Example 8 to the film adhesion test. The test results are shown in Table 9.

Table 9

| | First sub layer | Sample No. | Dry film adhesion before development (%) | Dry film adhesion after development (%) |
|---|---|---|---|---|
| Example 8 | Exemplified compound (1) | 58 | 80 | 80 |
| | Exemplified compound (3) | 59 | 90 | 80 |
| | Exemplified compound (5) | 60 | 90 | 90 |
| | Control compound (1) | 61 | 50 | 30 |
| | Control compound (3) | 62 | 70 | 50 |
| Example 9 | Exemplified compound (3) | 63 | 90 | 90 |
| | Exemplified compound (6) | 64 | 100 | 90 |
| | Exemplified | | | |

Table 9-continued

| First sub layer | Sample No. | Dry film adhesion before development (%) | Dry film adhesion after development (%) |
|---|---|---|---|
| compound (11) | 65 | 100 | 100 |
| Control compound (1) | 66 | 70 | 20 |
| Control compound (2) | 67 | 10 | 0 |

Table 9 shows that the sub layer formed on the support by use of the aqueous copolymer dispersion of the present invention provided excellent adhesion even to the diazonium light-sensitive layer formed thereon. Also, said layer showed favorable adhesion efficiency in the course of color development of the sample formed thereon in accordance with the present invention.

From Table 7, it is understood that even when the biaxially stretched polyethylene terephthalate film of 180 $\mu$ in thickness is used as a support which has been pretreated by ultraviolet irradiation to impart hydrophile

What we claim is:

1. A process for subbing a photographic hydrophobic film which comprises subjecting at least one surface of the film to pretreatment to make the surface hydrophilic, coating the pretreated surface with an aqueous disperson containing a copolymer comprising, as main comonomers and in a combined amount of more than 76% by weight, (1) 20 to 90 weight % of glycidyl methacrylate and/or glycidyl acrylate and (2) 10 to 60 weight % of at least one comonomer represented by the formula:

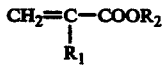

wherein $R_1$ is hydrogen or lower alkyl and $R_2$ is an aliphatic hydrocarbon residue of 1 to 9 carbon atoms, provided that a polymer comprising 20 to 60 weight % of glycidyl methacrylate and 25 to 60 weight % of ethyl acrylate in a combined amount of more than 76 weight % is excluded to form a coated surface and coating said coated surface with a colloidal silica to form a second sub layer 2. A process according to claim 1 wherein a particle diameter of the colloidal silica is less than 0.1 micron.

3. A process according to claim 1 wherein the second sub layer comprises 0.05 to 5 g/m$^2$ of silicic anhydride and sodium oxide, the amount of sodium oxide being 0.1 to 2.5 weight % based on silicic anhydride.

4. A process according to claim 1 wherein the copolymer further comprises, as an additional comonomer or monomers, at least one selected from the group consisting of vinylidene chloride, styrene, methyl methacrylate, ethyl methacrylate, butyl methacrylate, vinyl acetate, acrylonitrile and diacetone acrylamide, when the amount of comonomer (2) is larger than that of comonomer (1) in the copolymer.

5. A process according to claim 1 wherein the copolymer further comprises, as an additional comonomer or monomers, at least one selected from the group consisting of 2-ethylhexyl acrylate, isoprene and butadiene when the amount of comonomer (2) is smaller than that of comonomer (1) in the copolymer.

6. A process according to claim 1 wherein the copolymer further comprises, as an additional comonomer or monomers, at least one selected from the group consisting of an acrylic acid, a methacrylic acid, an itaconic acid, 2-sulfoethyl methacrylate and 2-sulfopropyl methacrylate, in an amount of less than 5 weight %.

7. A process according to claim 1 wherein the process further comprises drying the copolymer coating at 60 to 150° C to form a sub layer, the dried weight of which is from 0.05 to 5 g/m$^2$.

8. A process according to claim 7 wherein the process further comprises heating the dried sub layer at 100 to 180° C.

9. A process according to claim 7 wherein the process further comprises forming a second sub layer on the dried sub layer, the dry weight of the second sub layer being 0.05 to 5 g/m$^2$ and heating the second sub layer at 100 to 180° C.

10. A process according to claim 1 wherein the pretreatment is selected from the group consisting of corona dischargement, ultraviolet irradiation, flame treatment and treatment by an oxidizing agent.

11. A process according to claim 1 wherein the aqueous dispersion further contains a surface active agent.

12. A process according to claim 1 wherein in the formula $R_2$ is straight chain or branched alkyl of 1 to 6 carbon atoms when $R_1$ is hydrogen and $R_2$ is straight chain or branched alkyl of 5 to 9 carbon atoms when $R_1$ is methyl.

* * * * *